US012156549B2

(12) United States Patent
McNally et al.

(10) Patent No.: US 12,156,549 B2
(45) Date of Patent: Dec. 3, 2024

(54) SHORTS WITH INTEGRATED LINER

(71) Applicant: Saxx Underwear Co., Vancouver (CA)

(72) Inventors: Kathleen Marie McNally, Portland, OR (US); Peter Kallen, Portland, OR (US); Suzanne Renee Young, Portland, OR (US)

(73) Assignee: Saxx Underwear Co., Vancouver (CA)

( * ) Notice: Subject to any disclaimer, the term of this patent is extended or adjusted under 35 U.S.C. 154(b) by 320 days.

(21) Appl. No.: 16/809,190

(22) Filed: Mar. 4, 2020

(65) Prior Publication Data

US 2021/0274869 A1 Sep. 9, 2021

(51) Int. Cl.

| | |
|---|---|
| ***A41B 9/02*** | (2006.01) |
| ***A41D 1/089*** | (2018.01) |
| ***A41D 13/012*** | (2006.01) |
| ***A41D 27/02*** | (2006.01) |
| *A41D 20/00* | (2006.01) |

(52) U.S. Cl.

CPC ..... *A41B 9/02* (2013.01); *A41D 1/089* (2018.01); *A41D 13/012* (2013.01); *A41D 27/02* (2013.01); *A41D 20/00* (2013.01)

(58) Field of Classification Search

CPC ..... A41B 9/02; A41B 9/023; A41D 20/00; A41D 13/012; A41D 1/089; A41D 27/02; A41F 9/02

USPC ..... 2/78.2, 78.3, 403

See application file for complete search history.

(56) References Cited

U.S. PATENT DOCUMENTS

| | | | | | |
|---|---|---|---|---|---|
| 2,034,312 | A * | 3/1936 | Rubin | A41D 1/06 | 2/404 |
| 2,599,769 | A * | 6/1952 | MacRae | A41D 1/089 | 2/404 |
| 3,333,589 | A * | 8/1967 | Cohen | A41D 7/005 | 450/118 |
| 3,638,242 | A * | 2/1972 | Herter | A41F 9/02 | 2/237 |
| 3,784,986 | A * | 1/1974 | Klaproth | A41F 9/025 | 2/237 |
| 4,523,337 | A * | 6/1985 | Leibowitz | A41B 9/14 | 2/237 |
| 4,669,130 | A * | 6/1987 | Brown | A41B 9/001 | 2/403 |

(Continued)

FOREIGN PATENT DOCUMENTS

| | | | |
|---|---|---|---|
| CH | 645520 | | 10/1984 |
| EP | 2815662 | A1 | 12/2014 |
| FR | 2564706 | A1 * | 11/1985 |

OTHER PUBLICATIONS

"Patent Translate" Translation of FR 2,564,706; Translation obtained on Nov. 22, 2022 via Espacenet (Year: 2022).*

(Continued)

*Primary Examiner* — Jocelyn Bravo

(74) *Attorney, Agent, or Firm* — Chernoff, Vilhauer, McClung & Stenzel LLP

(57) ABSTRACT

The present invention improves upon contemporary shorts with integrated liners by providing a short with liner, the liner being affixed to the waistband of the short along a majority of the circumference of the short. A detached, dropped section along the front of the liner, has stretchable waistband that allows a user to enlarge the opening of the detached area.

20 Claims, 9 Drawing Sheets

(56) References Cited

U.S. PATENT DOCUMENTS 5,271,101 A * 12/1993 Speth ..... A41D 1/084 2/214
5,598,586 A * 2/1997 Munjone ..... A41D 1/08 2/237
5,978,971 A * 11/1999 Wald ..... A41B 9/02 2/403
6,061,839 A * 5/2000 Smolik ..... A61F 13/5611 2/403
6,108,823 A * 8/2000 Danes ..... A41B 13/04 2/403
6,145,132 A * 11/2000 Towner ..... A41B 9/02 2/400
6,243,880 B1 * 6/2001 Lyden ..... A41B 9/02 2/400
6,353,940 B1 * 3/2002 Lyden ..... A41B 9/02 2/403
D461,622 S 8/2002 Lyden
D463,091 S 9/2002 Fyden
6,550,288 B2 * 4/2003 Browder, Jr. ..... D04B 1/243 66/177
6,665,882 B1 * 12/2003 Pedrick ..... A41D 7/005 2/228
6,789,270 B1 9/2004 Pedrick
6,996,851 B2 * 2/2006 Nordness ..... A41B 9/008 2/919
7,032,249 B2 * 4/2006 Smith ..... A41D 1/08 2/407
7,124,448 B2 * 10/2006 Davenport ..... A41F 9/02 2/229
9,968,147 B1 * 5/2018 Lindquist ..... A41D 27/204
10,154,702 B1 * 12/2018 Neary ..... A41D 1/06
2004/0031088 A1 * 2/2004 Soderstrom ..... A41B 9/02 2/227
2004/0098784 A1 * 5/2004 Desai ..... A41B 9/00 2/69
2005/0081275 A1 * 4/2005 Galvao ..... A41D 7/005 2/67
2005/0142986 A1 * 6/2005 Belpaume ..... A41D 1/08 450/99
2005/0223462 A1 * 10/2005 Snedeker ..... A41F 9/025 2/69
2005/0229293 A1 * 10/2005 Miller ..... A41D 1/089 2/403
2005/0268380 A1 * 12/2005 Sovell ..... A41B 9/023 2/400
2006/0000008 A1 * 1/2006 Chong ..... A41B 9/023 2/403
2006/0005301 A1 * 1/2006 Taylor ..... A41B 9/02 2/403
2007/0028364 A1 * 2/2007 Oomae ..... A41F 9/025 2/237
2007/0180601 A1 * 8/2007 Chou ..... A41B 9/02 2/403
2007/0220661 A1 * 9/2007 Blohmann ..... A41B 9/023 2/404
2007/0245463 A1 * 10/2007 Kang ..... A41B 9/023 2/403
2007/0277285 A1 * 12/2007 Gravette ..... A41B 9/023 2/78.1
2007/0283484 A1 * 12/2007 Wright ..... A41B 9/02 2/403
2008/0052807 A1 * 3/2008 Lai ..... A41B 9/023 2/400
2008/0072363 A1 * 3/2008 Williams ..... A41B 9/02 2/403
2008/0109945 A1 * 5/2008 Xia ..... A41B 9/023 2/403
2008/0178369 A1 * 7/2008 Kitsch ..... A41B 9/023 2/405
2009/0038046 A1 * 2/2009 Moore ..... A41D 1/08 2/67
2009/0064388 A1 * 3/2009 Baiany ..... A41D 27/02 2/67
2009/0158505 A1 * 6/2009 Fleming ..... A61F 13/471 2/403
2011/0307996 A1 * 12/2011 Radford ..... A41B 9/02 2/403
2012/0124712 A1 * 5/2012 Vanlandingham ... B65D 75/008 2/400
2012/0210495 A1 * 8/2012 Wilson ..... A41D 1/089 2/236
2012/0255103 A1 * 10/2012 Evenstad ..... A41B 9/02 2/405
2012/0260400 A1 * 10/2012 Franz ..... A41D 27/04 2/236
2013/0091619 A1 * 4/2013 Hacker ..... A41D 1/08 2/228
2014/0359920 A1 * 12/2014 Sabin ..... A41B 9/002 2/406
2016/0095367 A1 * 4/2016 Curran ..... A41D 27/285 2/243.1
2018/0070654 A1 * 3/2018 McGargill ..... A41D 27/205
2019/0373970 A1 * 12/2019 Bolker ..... A41B 9/001
2019/0387809 A1 * 12/2019 Perry ..... A41B 9/02
2020/0214377 A1 * 7/2020 Horbatuck ..... A41D 7/00
2020/0229516 A1 * 7/2020 Curran ..... A41D 1/06
2020/0297040 A1 * 9/2020 Weber-Unger ..... A41B 9/02
2020/0375274 A1 * 12/2020 McNally ..... A41D 1/089
2021/0274869 A1 * 9/2021 McNally ..... A41D 13/012

OTHER PUBLICATIONS

International Search Report prepared by the European Patent Office for PCT/US2020/040295, Nov. 3, 2020, 5 pages.
Written Opinion prepared by the European Patent Office for PCT/US2020/040295, Nov. 3, 2020, 7 pages.

* cited by examiner

SHORTS WITH INTEGRATED LINER

FIELD OF THE INVENTION

The present invention relates to fixed or elastic-waist sports attire and, in particular, to a shorts garment with a liner attached within the shorts at the waistband of the shorts, and further comprising a separation between the liner and the short along part of the front of the short so that an opening along the top of the liner is formed.

BACKGROUND OF THE INVENTION

Various attempts have been made to provide apparel designs having integral undergarments therewith. For example, US 2007/0283484 A1 (Male underwear garment) by Wright and U.S. Pat. No. 5,978,971 A (Male boxer shorts with integrated male briefs) by Wald both disclose a pair of men's underwear consisting of a pair boxer style underwear having a pair of brief style underwear therein, with the two sewn together about the waistband of each.

U.S. Pat. No. 7,124,448 B2 (Pants construction stabilized by integral undergarment) by Davenport discloses a pants construction whereby the pants are worn far below the waist, exposing the undergarment, with the undergarment holding the pants from falling down.

U.S. Pat. No. 6,789,270 B1 (Combined surfing shorts and wet suit undergarment) and U.S. Pat. No. 6,665,882 B1 (Surfing shorts with wetsuit undergarment) by Pedrick disclose a wet suit undergarment and surfing shorts combination made of Neoprene or similarly insulated wet suit material.

U.S. Pat. No. 6,108,823 A (Interconnected undergarment and diaper combination) by Danes discloses an incontinence system consisting of a reusable undergarment and a disposable diaper which is removably fastened within the undergarment.

U.S. Pat. No. 2,599,769 A (Sport shorts) by MacRae et al. discloses a pair of shorts having brief style underwear fastened therein along the rear half of the waistbands of the shorts and underwear.

U.S. Pat. No. 2,034,312 A (Garment for boys) by Rubin discloses a pair of shorts having underwear fastened therein with elastic band material on each side of the waistbands of the shorts and underwear.

CH 645,520 (Article of underwear in the form of long-legged undertrousers) by Amberg discloses undertrousers detachably fitted in a pair of trousers using loops of material which vertically wrap around a band fastened along the waistband of the undertrousers.

U.S. Pat. No. 6,243,880 B1 (Athletic shorts having an inner liner), U.S. D463,091 S (Women's underwear/inner liner for athletic shorts), U.S. D461,622 (Men's underwear/inner liner for athletic shorts), and by U.S. Pat. No. 6,353,940 B1 (Underwear design for men) by Lyden disclose a pair of shorts having a particularly shaped brief style inner liner.

U.S. Pat. No. 5,598,586 (Athletic shorts with inner and outer layers) by Munjone discloses a pair of shorts having inner and outer layers affixed together at the waistband of the outer layer.

U.S. Pat. No. 6,550,288 B2 (Lower torso garment with integral panty and method of making same) by Browder, Jr. et al. discloses a lower torso garment having an integral briefs, with the waistband of the lower garment connecting together the lower garment and the integral briefs.

None of the prior attempts, however, provide suitable designs for a pair of active shorts with integral undergarment.

What is needed is a pair of shorts that can be worn during watersports with an integrated liner and a detached area long the front for a user's convenience.

BRIEF SUMMARY OF THE PRESENT INVENTION

The present invention improves upon contemporary shorts with integrated liners by providing a fixed waist short with fly and liner, the liner being affixed to the waistband of the shell along a majority of the circumference of the shell. A detached, dropped section along the front of the liner, has stretchable materials and construction that allows a user to enlarge the opening of the detached area.

The short is intended to be used during watersports such as surfing, swimming, water skiing or outdoor activities such as running, hiking, trekking and fishing. In an embodiment of the present invention, the exterior shell is comprised of a stretch woven mix of polyester and elastic. The liner is similarly comprised of knitted polyester and elastic, or other materials suitable for use in a liner, but can be of different proportions than that of the shell. In some embodiments of the present invention, the liner is a mesh fabric with holes in the mesh knitting of sufficient size to allow for the quick and easy drainage of water. The mesh liner prevents accumulation of water against the skin which would cause discomfort for users. Furthermore, efficient evacuation of water through the mesh aids in the drying of the liner.

The general shape of the liner, in some embodiments of the present invention, resembles boxer brief liners. The boxer brief liner is attached to the shell of the short at the inner waistline of the shell. Attachment to the shell can be done by way of stitching or another method of fixedly securing the liner to the short. The stitching of the boxer brief liner to the shell extends along the back of the shell, around to each side of the shell, and partially around the front of the shell. Where the liner is not attached to the shell, the liner is provided with a binding that finishes at its center front.

In an embodiment of the present invention, a pair of boxer-brief liner, hereinafter referred to as the "liner", is presented that is attached by way of stitching to a fixed-waist short, hereinafter referred to as the "shell". The liner comprises a stretchable partial waistband that is located at the front top of the shell. That is, the liner's stretchable waistband is centered above the front center of the shell and is a width less than the width of the front half of the shell. The liner's waistband is connected to the shell at each end of the waistband. The waistband transitions into stitching between the liner and the shell of the fixed-waist short at the connection points. The rear of the liner has no separate waistband. Of the 360 degrees of the circumference of the shell, the waistband of the liner comprises less than 180 degrees.

In an embodiment of the present invention, the liner is a full liner with a fly and standard liner construction. The liner has mesh gussets, flat seams, and the fly opening is turned to a clean finish. The liner provides male genital separation from inner leg contact, and improved comfort and support. A specifically shaped, breathable pouch is provided in combination with elasticized, breathable, and wicking mesh material side panels. The combination of the side panels and shaped pouch serve to keep the male genitalia supported, dry and separated from inner-leg contact. The side panels and shaped pouch comprise an internal double side-panel containment system and an anatomical pouch compartment.

The lower extremity of the pouch extends under and rearwardly of the front wall to form a perineum portion for covering rearwardly past the scrotum and to the perineum of the user. The pouch also has a phallus supporting portion extending forwardly of a plane generally containing the front wall and forming therein an apex portion for containing the head of the penis of the user when the penis is hanging at rest. The pouch also has a scrotum supporting portion extending from and between the phallus Supporting portion and the perineum portion for containing at least a portion of the scrotum of the user.

The present invention makes use of light internal fabric and moisture control athletic performance fabrics to control moisture, reduce odor, and resist odor. An embodiment of the present invention provides a liner with a moisture wicking odor-resistant finish, the finish being applied to a stretchable, form-fitting athletic fabric. The fabric is a blend of synthetic fibers and spandex. The short is constructed from synthetic fibers and has a mechanical welt stretch and wicking finish. Accessories or additional components such as zippers, buttons, snaps and the like are made from a variety of other fabrics, metals, or plastics.

DETAILED DESCRIPTION OF PREFERRED EMBODIMENTS

Figure 1:
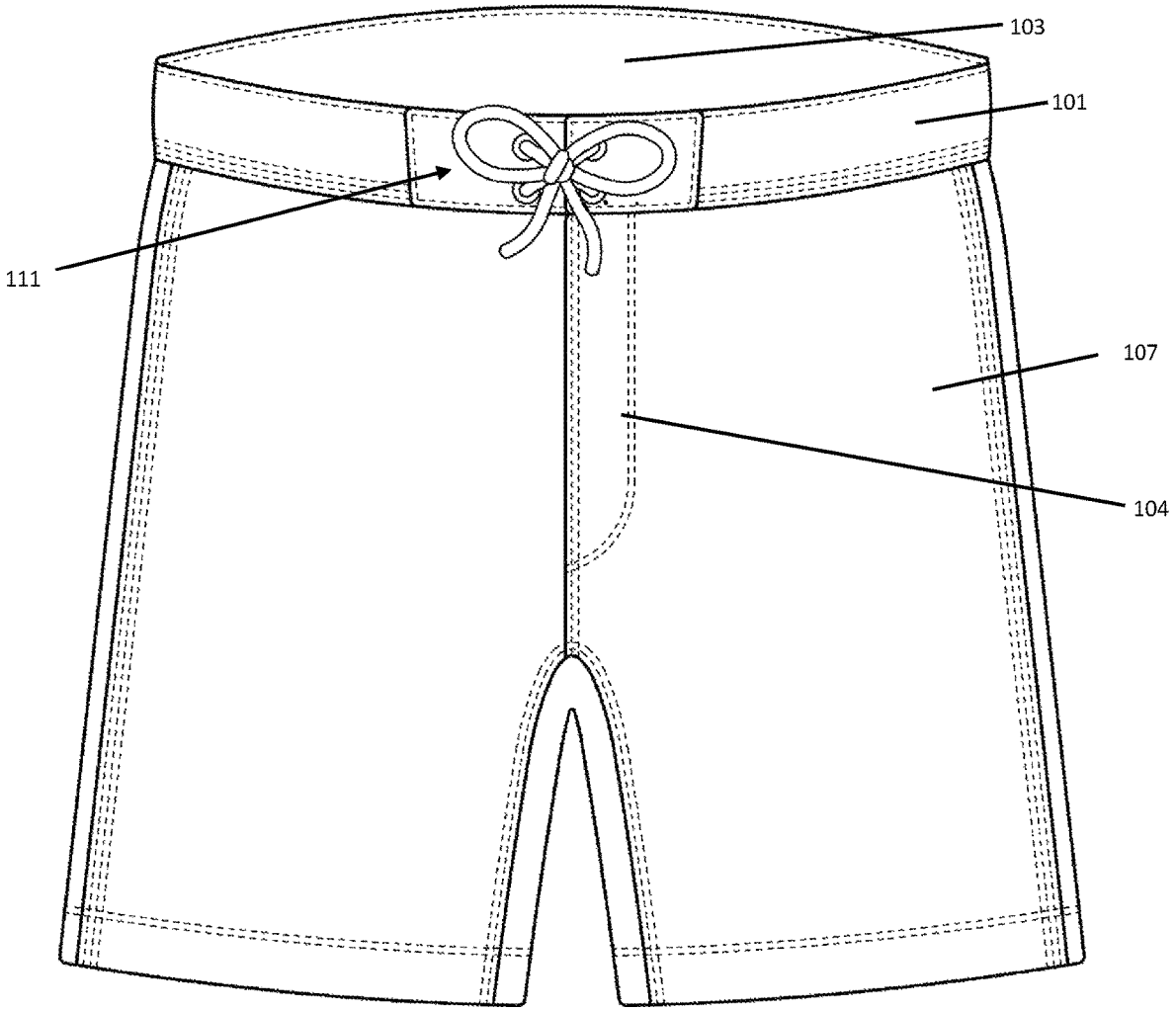
FIG. 1 is a front view of the shell of a short as according to an embodiment of the present invention.
Figure 2:
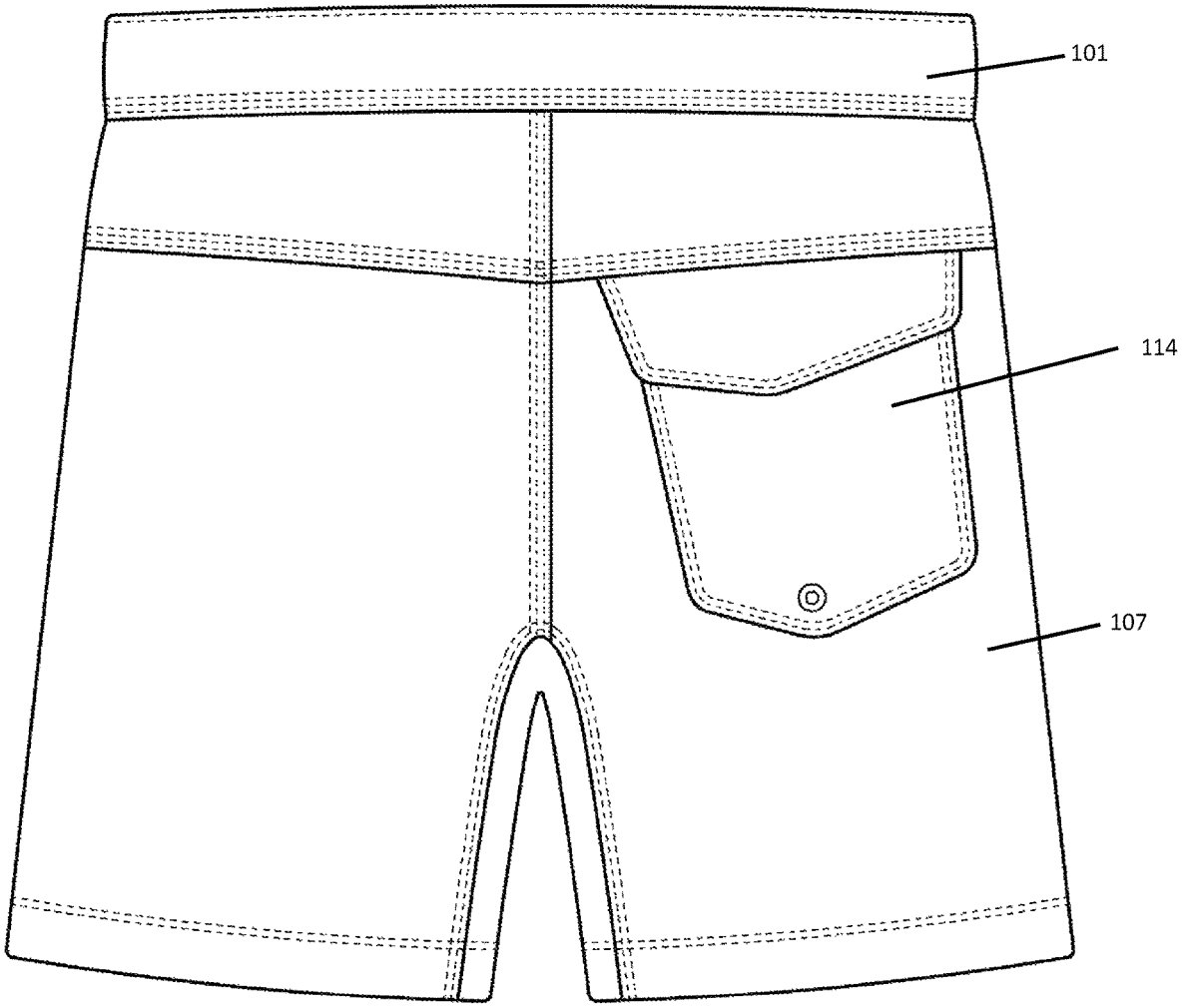
FIG. 2 is a rear view of the shell of a short as according to an embodiment of the present invention.
Figure 3:
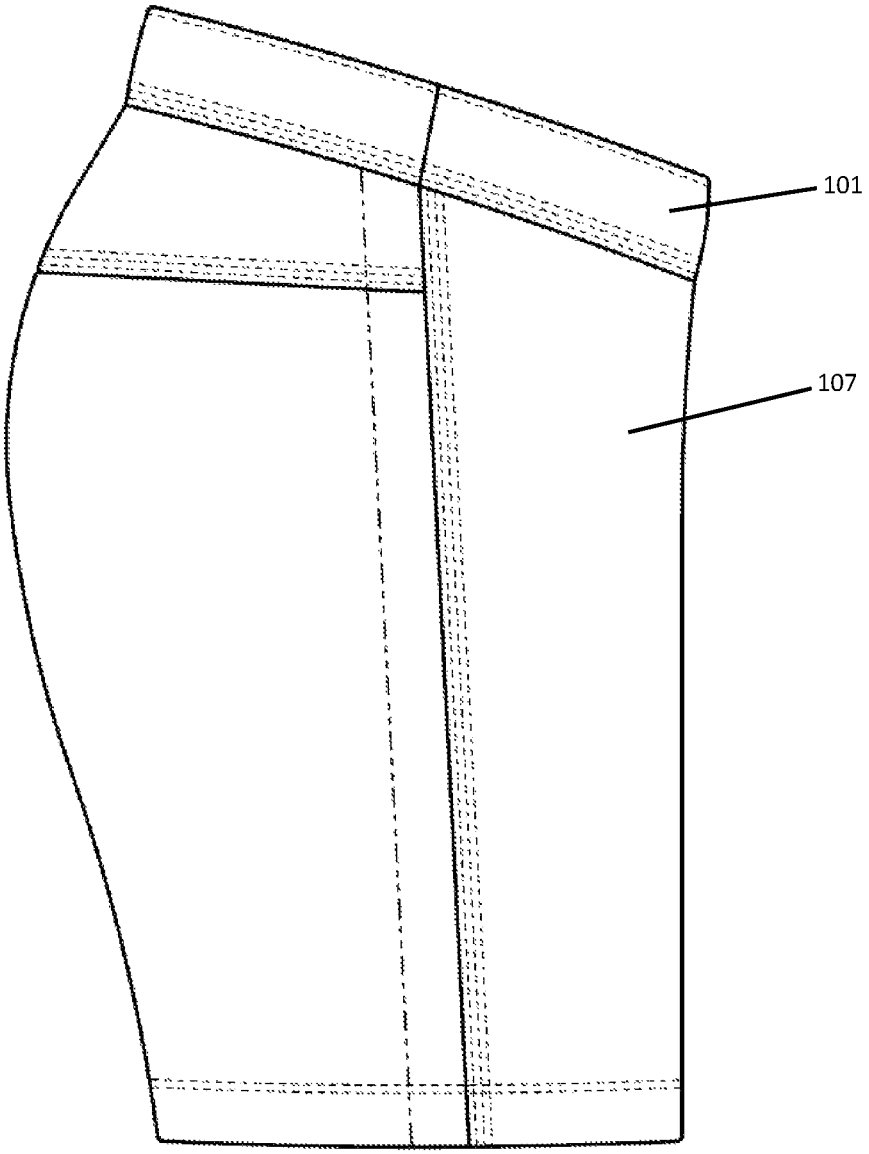
FIG. 3 is a right-side view of the shell of a short as according to an embodiment of the present invention.
Figure 4:
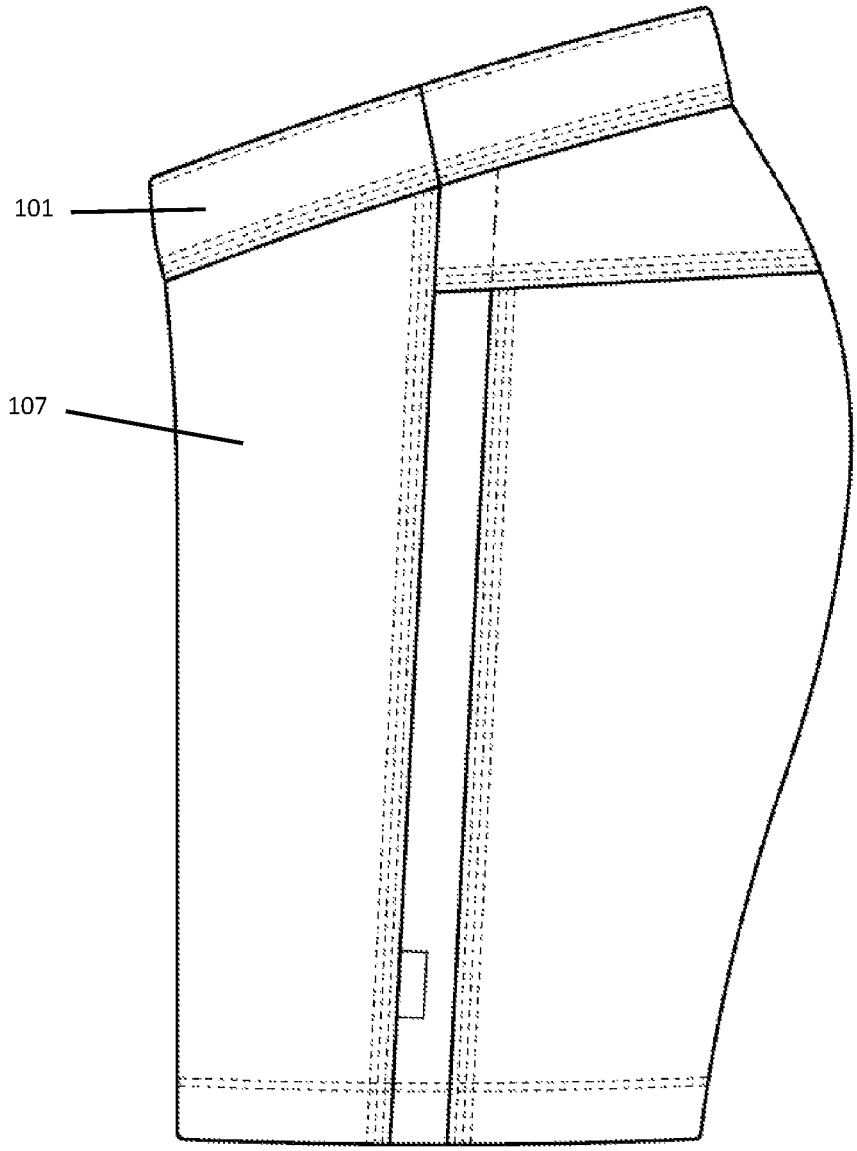
FIG. 4 is a left-side view of the shell of a short as according to an embodiment of the present invention.
Figure 5:
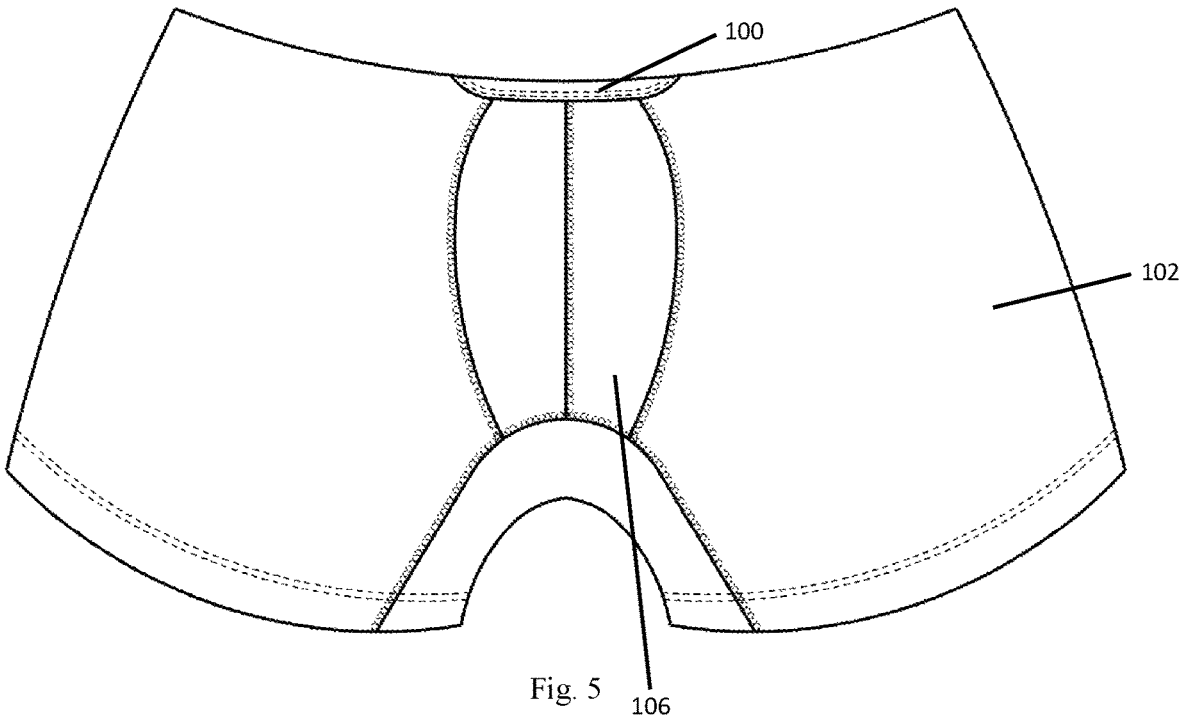
FIG. 5 is a front view of a liner with an adjustable waistband as according to an embodiment of the present invention.
Figure 6:
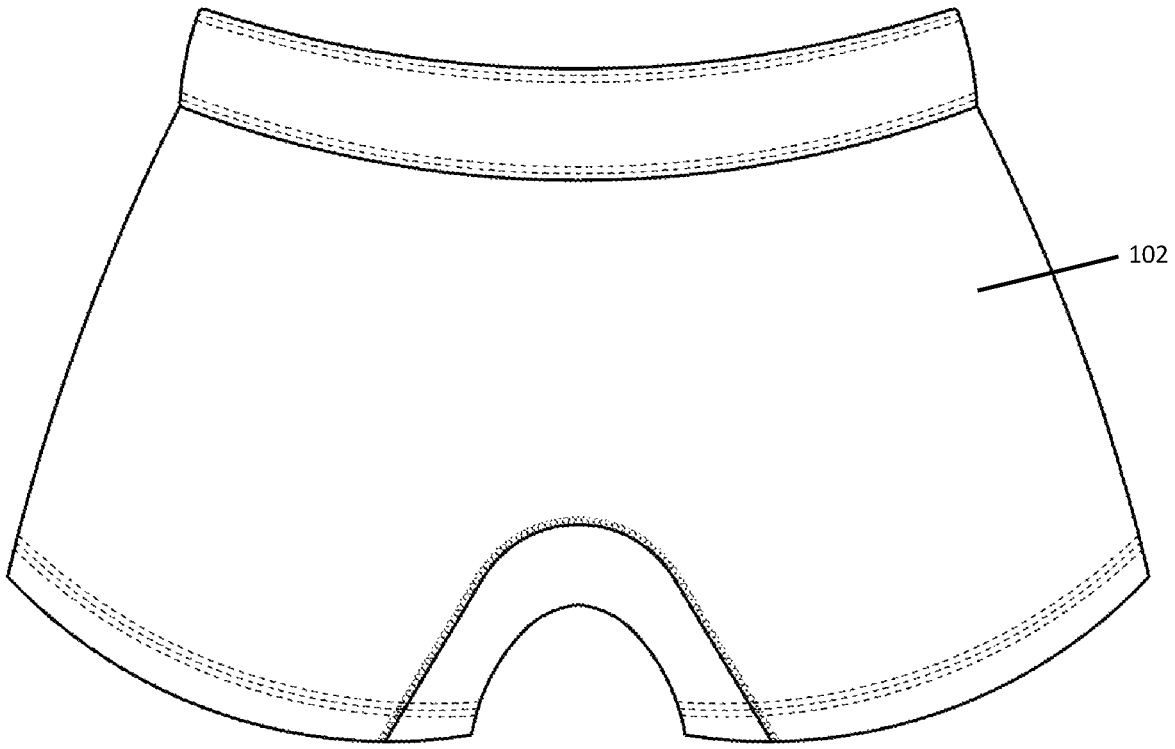
FIG. 6 is a rear view of a liner with an adjustable waistband as according to an embodiment of the present invention.
Figure 7:
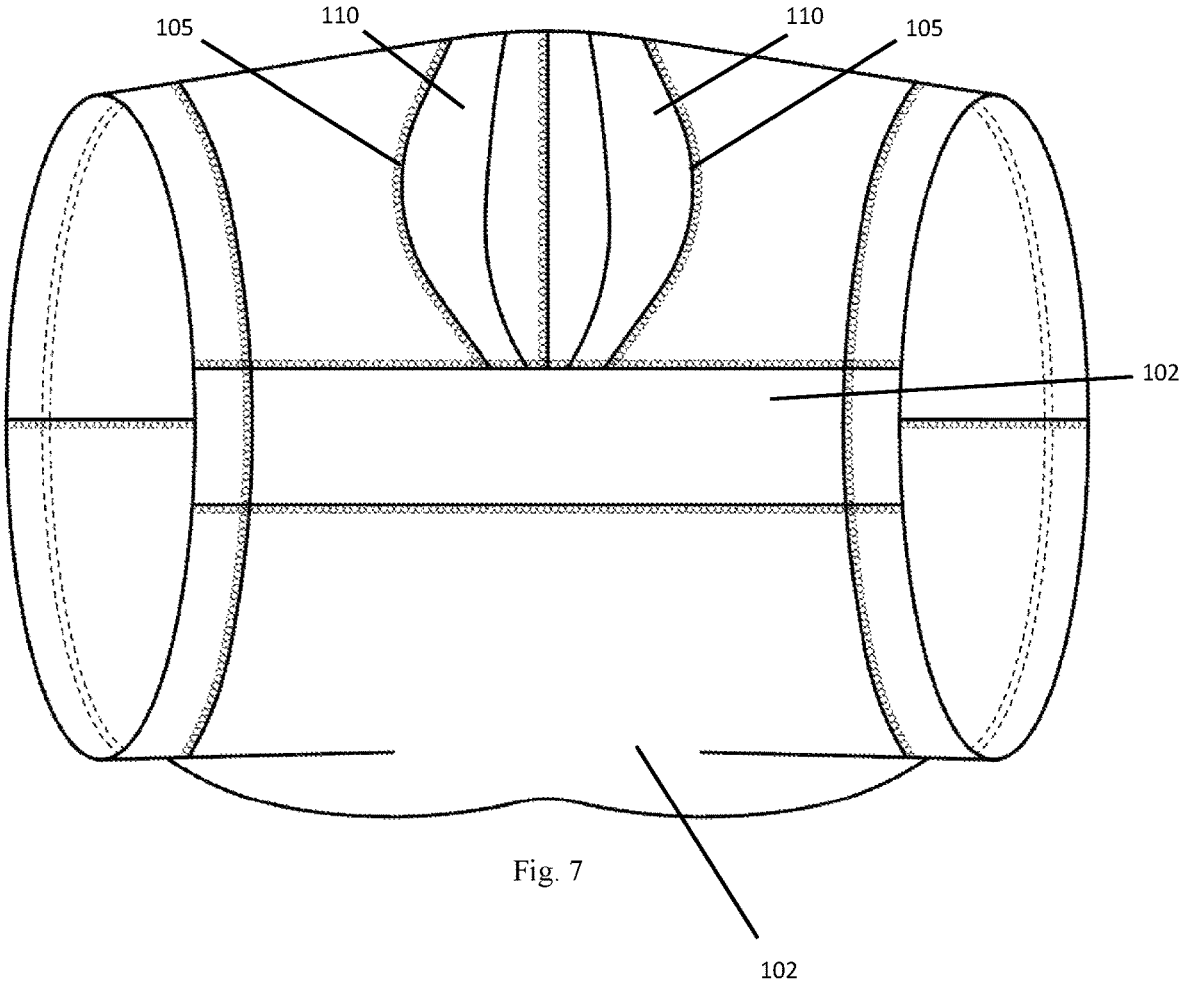
FIG. 7 is a bottom view of a liner with an adjustable waistband attached to a liner waistband as according to an embodiment of the present invention.

Referring now to the attached Figures that will be discussed together, the present invention comprises a liner (102) with a partial, stretchable waistband (100) that is integrated into a short (107). The short (107) has a non-stretchable waistband. For purposes of this Disclosure, the term "short" shall comprise a pair of shorts that can be considered a type of swimwear or a type of casual wear that are designed to be quick drying and generally made from polyester, nylon, or a combination thereof. The short (107) has a non-stretchable or partially stretchable waistband. That is, they are a pair of shorts with a waistband that either does not contain elastic, is not stretchable, or is stretchable only in part of the waistband. The waistband of the short (107) is constructed from a non-stretch material such as polyester. A short (107) can contain a drawstring, button, snaps, elastic, webbing, or other attachment device that allows the shorts to be adjustably tightened on a user.

The combination of the liner (102) with the stretchable waistband (100), also referred to as the "liner" (102), and the short (107) with the non-stretchable waistband (101), also referred to as the "short" (107) provides a garment that is more comfortable, has fewer layers of material, and comprises a better wearing experience than shorts found within the prior art. The present invention also reduces the discomfort caused when multiple layers of material bunch together creating knots or balls that press against a user. This is of particular concern with shorts when a user is lying on a surfboard or their body contacts another rigid surface.

The attachment of the liner (102) to the short (107) provides a garment that simplifies, and makes more comfortable, the wearing experience of shorts and liner as compared to embodiments of the prior art. Shorts with a liner (102) attached to the short (107) as provided by the present invention are comfortable to wear in and out of water and reduce chafing as compared to embodiments of the prior art. Additionally, embodiments of the prior art have not provided shorts, such as a board short, with a liner (102) as provided by the present invention. Users seeking certain styles of shorts, such as board shorts, could not have that style with the comfort provided by an integrated liner (102).

The liner's partial waistband (100) is a stretchable waistband, positioned along the top and front of the liner (102) that finishes into the short's waistband (101) on either side of the fly (104) of the short (107). That is, the liner's partial waistband (100) is a stretchable device that causes the top of the liner (102) to form fit against a user's body when in a relaxed state. When in an expanded state, the waistband (100) stretches to create an opening into the liner (102).

The waistband (100) extends partially along the top front half of the liner (102). When the liner (102) is viewed alone, the waistband area along the sides and rear portion of the liner (102) is an empty area (103). Areas where there is no waistband on the liner (102) are empty because that is where the waistband of the fixed short (101) is attached. The liner's partial waistband (100) is attached to the short's waistband (101) roughly at the sides of the fly area of the liner (102). The attachment between the liner's partial waistband (100) and the shorts' waistband (101) is a clean finish (113) so that the joining of the two is flat and comfortable to wear.

The liner's relatively small waistband (100) allows for more of the liner (102) to be attached to the short (107). By attaching more of the liner (102) to the short), the liner (102) rests within the short (107) in a more secure, less prone to movement fashion. When a user enters into aqueous environments such as the ocean, a lake, or a pool, the force of the water on the liner (102) may cause it to move within the short (107). The design of the present invention minimizes unwanted movement of the liner (102) by having it be secured to the short (107) along most of the short's waistband (101). The liner's flexible waistband (100) is detached from the short (107) so that an opening can be formed into the liner (102). The flexible waistband (100) is relatively small compared to the size of the short's waistband (101). But the flexible waistband can stretchably enlarge when opened by a user. The waistband (100) is dropped, curved downward in shape, to further facilitate the opening of the liner (102) by the user. The downward curve of the waistband (100) serves to increase the size of the opening while minimizing the overall length of the waistband (100).

The sides and rear portions of the liner (102) are attached to the short's waistband (102) by way of stitching (113). It is the top part of the liner (102) that is stitched to the bottom part of the short's waistband (101). The empty area (103) of the liner allows the waistband of the short (101) to fit in a flush, flat manner on a user wearing the present invention. By having only a partial waistband (102) along a portion of the front of the liner (102) and leaving an empty area (103) along the top rear of the liner (102), the liner (102) is optimally constructed to create a comfortable, flush fit when combined with a short (107). The stitching (113) of the liner (102) to the short (107) prevents the liner (102) from moving or bunching when worn by a user. The attachment of the liner (102) begins at approximately the edges of the fly of the liner (102) and extends along the entire rear portion of the liner (102) and short (107) but not along the entire front of the liner (102) or short (107). This allows the liner to stretchably fit to the contours of the user and creates a more comfortable, pleasing fit.

In some embodiments, the liner's partial waistband (100) is elastic or made from a stretchable material so that it can expand or contract and provide a tighter, more comfortable fit for the wearer. As the elasticity of the liner's partial waistband (100) causes it to contract, the liner (102) fits more snugly on a user. However, because the waistband of the liner (102) is sewn directly to the short (107) and the rear portion of the liner (102) is attached to the waistband of the short (107) instead of having a separate waistband that is combined with the short (107) there is no bunching of material along the rear of the short's waistband (101) as would occur if a user were wearing a typical liner. The fixed short's waistband (101) is constructed from either a stretch fabric or a non-stretchable material in the waistband (101). In some embodiments, the short (107) is constructed from polyester but can have trim or other components made from, differing materials.

The short (107) has many features, trim, and additional components as found on conventional shorts. It can comprise a drawstring (111) as illustrated in FIG. 1. The drawstring (111) pulls together the sides of the short (107) when tightened or tied. Another feature of the short (107) can be a mesh gusset (112) at the crotch point. The mesh gusset (112) reduces stress from the tight-fitting liner (102). The mesh gusset (112) also provides additional breathability and ease of movement. It can also provide some cooling and comfort for a user by allowing for airflow through the holes in the mesh fabric.

The liner (102) is constructed of a 4-way stretch material or semi-stretch material so that the liner (102) can provide a tight fit to the user. In some embodiments, the material is a blend of nylon, spandex, and polyester that have stretch and wicking characteristics. The liner (102) can be coated in an odor resistant finish for hygiene and odor control purposes. The liner (102) is attached to the short (107) by clean finish stitching (113) along the front of the short (107). A clean finish is a simple straight stitching that is used to create a seam finish. In some embodiments, a seam finish can be a simple line of stitching to prevent fraying beyond that stitching. Occasionally a clean finish is combined with a pinked seam finish or is sewn under the edge.

There is a genital pouch (106) that is shaped to support and keep separate a male's genitalia and phallus from contacting his legs. The genital pouch (106) and a pair of side panels (110) are collectively formed in amid-section of a front wall depending from the liner's partial waistband (100) to bisect said front wall. The pouch (106) may be pear-shaped when viewed from the front. A lower extremity of the pouch (106) extends under and rearwardly of the front wall to form a perineum portion for covering rearwardly past the scrotum and to the perineum of the user. The pouch (106) also has a phallus supporting portion extending forwardly of a plane generally containing the front wall and forming an apex portion for containing the head of the penis of the user when the penis is hanging at rest. The pouch (106) also has a scrotum supporting portion extending from and between the phallus supporting portion and the perineum portion for containing at least a portion of the scrotum of the user.

The side panels (110) are a pair of laterally spaced apart, substantially parallel side panels (110) forming upwardly from adjacent the perineum generally vertical extending scrotum fences towards the partial waistband (100). The side panels (110) are spaced so as to snugly engage sides of the scrotum and to substantially completely cover over and support the sides of the scrotum and to extend upwardly into a fold along a lowermost aspect of the abdomen of the user formed between the scrotum and the inner thighs of the user so as to substantially entirely cover exposed thigh skin in the fold exposed for rubbing against scrotum skin in the fold. Advantageously the side panels (110) are formed as opposed facing concavities to cup the scrotum and the side panels (110) and pouch are formed of elasticized breathable wicking mesh. The side panels may be scimitar-shaped when viewed from the side to form, along with the pouch (106), the scrotum supporting portion as a crescent half-moon-shaped basket.

Further advantageously, the pouch (106) is smooth and seamless over a central penis-covering portion thereof, and the concavities of the side panels (110) are formed at least in part by folding laterally inwardly and stitching uppermost ends of the side panels (110) so as to fold over an uppermost edge of the side panels (110). In one embodiment this is done where the side panels (110) extend up to the partial waistband (100), and where the pouch (106) also extends between the side panels (110) substantially up to the partial waistband (100). In one embodiment the concavities of side panels (110) are formed by folding over inwardly, and stitching (105) with the fold-over in place, the upper ends of side panels (110) where side panels (110) are stitched to the front walls and partial waistband (100) of the liner (102).

Figure 8:
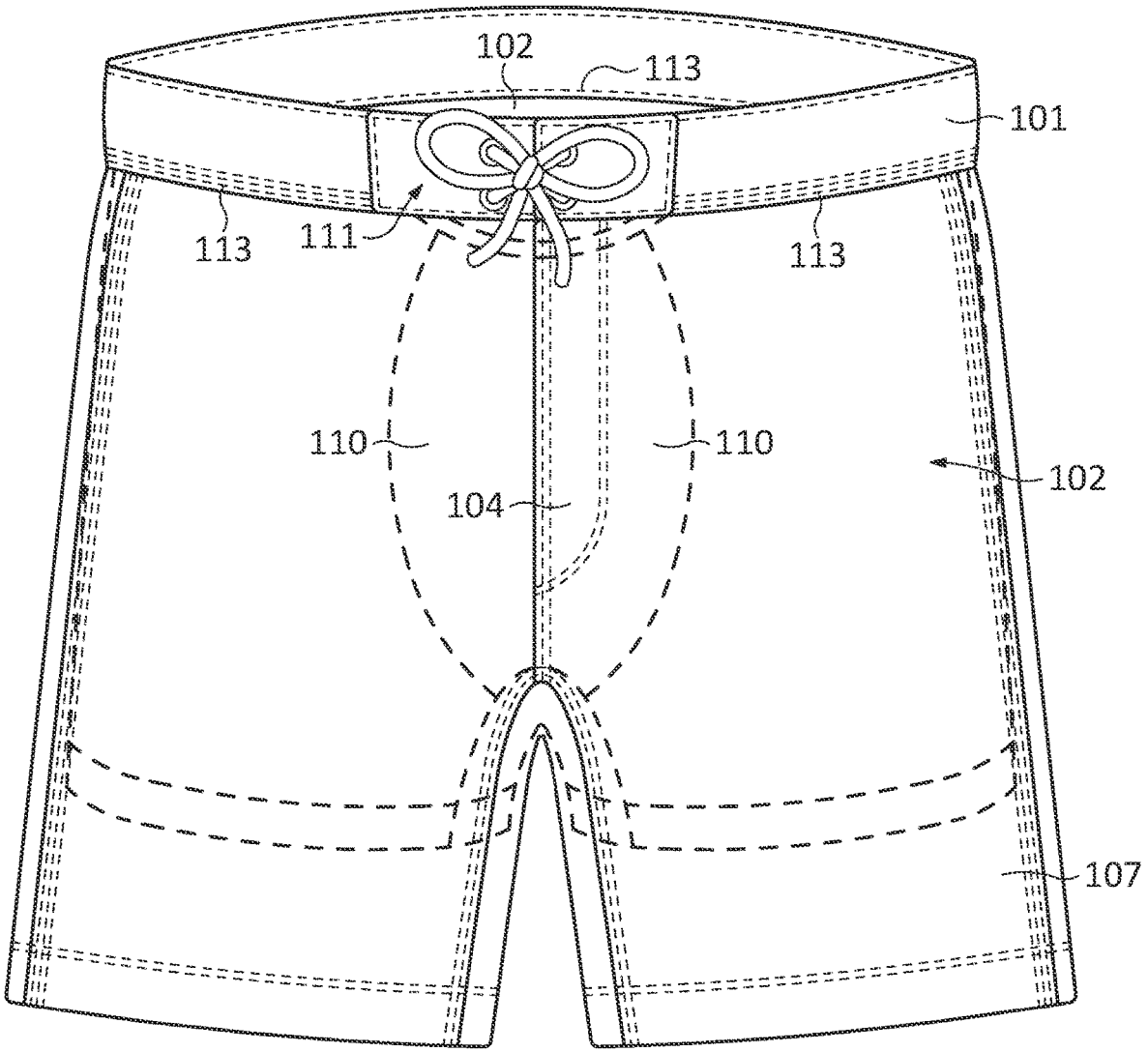
FIG. 8 is a front view of the shell of a short with an integrated liner having a stretchable waistband as according to an embodiment of the present invention.
Figure 9:
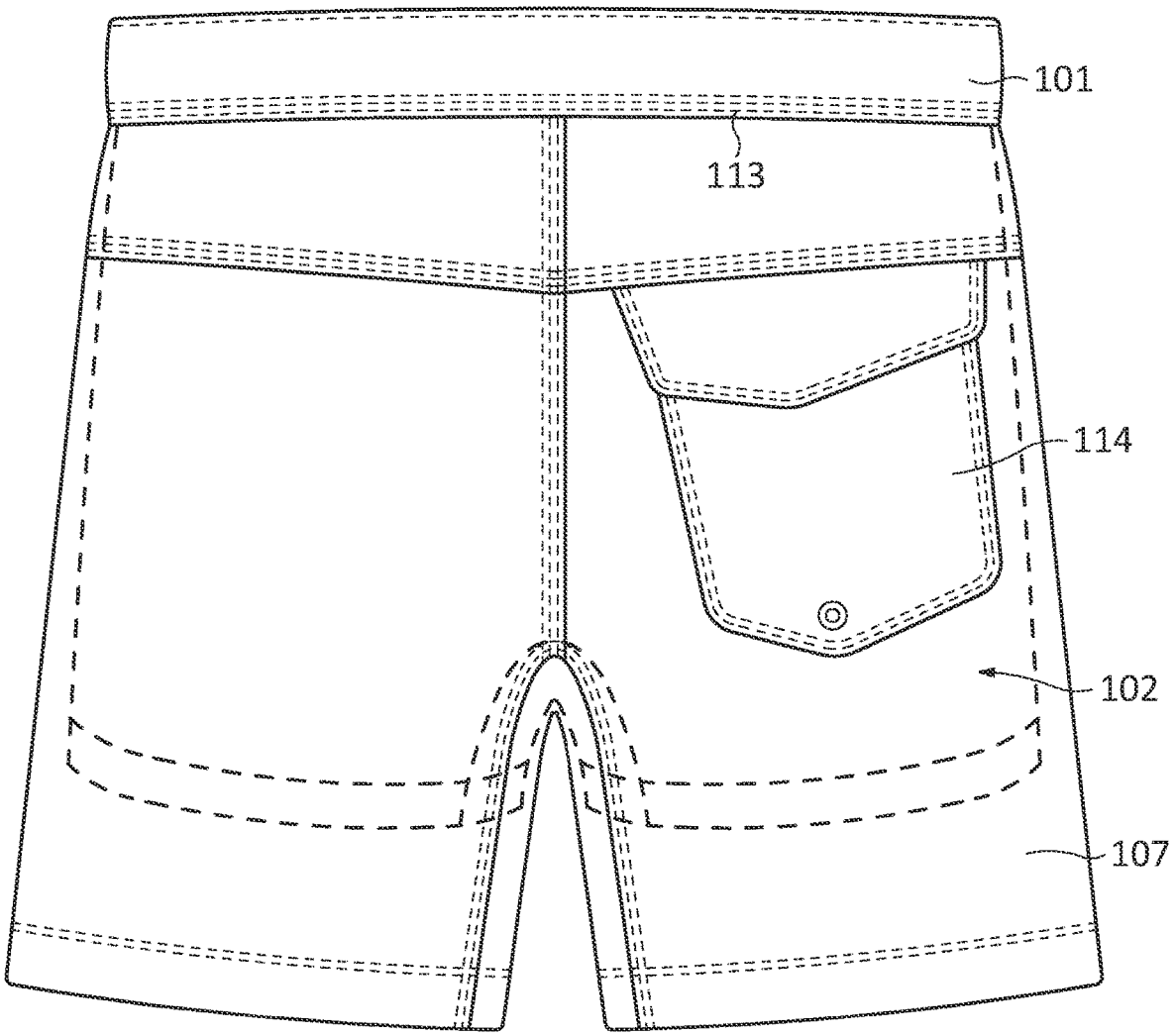
FIG. 9 is a rear view of the shell of a short with an integrated liner having a stretchable waistband as according to an embodiment of the present invention.

Some embodiments of the present invention have an opening in the front of the liner (102) commonly referred to as a fly (104). The fly (104) is formed as part of, or to the side of, the pouch (106). Embodiments with a fly (104) are illustrated in FIGS. 1 and 8.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference. The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. A pair of shorts for a user, the pair of shorts having an integral liner and comprising:

shorts constructed of a non-stretch material, the shorts having a non-stretchable waistband;

the integral liner constructed of a material, the integral liner having a stretchable partial waistband;

wherein the stretchable partial waistband of the integral liner extends along a portion of a front of the integral liner, wherein a central portion of the stretchable partial waistband is not attached to the waistband of the shorts, wherein lateral side portions of the stretchable partial waistband of the integral liner are attached by clean finish stitching combined with a pinked seam finish to the non-stretchable waistband of the shorts on either side of a fly area of the integral liner; wherein a remaining portion of the integral liner is attached to a bottom of the non-stretchable waistband of the shorts; and wherein the central portion of the stretchable partial waistband is dropped and curved in a downward, concave shape.

2. The pair of shorts with an integral liner of claim 1 further comprising a genital pouch formed into the integral liner that is configured to support a user's genitals, wherein the genital pouch includes laterally spaced side panels formed in a mid-section of the front of the integral liner depending from the partial waistband of the liner to bisect the front of the integral liner, wherein a lower extremity of the genital pouch extends under and rearwardly of the front of the integral liner to form a perineum portion.

3. The pair of shorts with an integral liner of claim 1 wherein the integral liner is constructed from semi-stretch material.

4. The pair of shorts with an integral liner of claim 1 wherein the integral liner is constructed from a stretch material which is not a mesh material.

5. The pair of shorts with an integral liner of claim 1 wherein in the non-stretch material that the shorts are constructed from is polyester.

6. The pair of shorts with an integral liner of claim 1 wherein the attachment of the integral liner to the bottom of the waistband of the shorts extends from approximately one side of the fly area of the integral liner to approximately another side of the fly area of the integral liner.

7. The pair of shorts with an integral liner of claim 1 wherein the integral liner is coated with an odor resistant finish.

8. A pair of shorts with an integrated liner comprising:

shorts constructed of a non-stretch material, the shorts having a non-stretchable waistband;

the integrated liner constructed of a material, the liner having a stretchable partial waistband;

wherein a central portion of the stretchable partial waistband of the integrated liner extends along a portion of a top front of the integrated liner and is not attached to the shorts;

lateral side portions of the stretchable partial waistband of the integrated liner being attached by clean finish stitching combined with a pinked seam finish to the non-stretchable waistband of the shorts at both sides of a fly area of the integrated liner; wherein a remainder of the waistband of the integrated liner is attached to a bottom of the non stretchable waistband of the shorts; and wherein the central portion of the stretchable partial waistband is dropped and curved in a downward, concave shape.

9. The pair of shorts with integrated liner of claim 8 further comprising a fly that is constructed as part of the integrated liner.

10. The pair of shorts with integrated liner of claim 8 wherein the material of the integrated liner is a blend of polyester, spandex, and nylon.

11. The pair of shorts with integrated liner of claim 8 further comprising constructing the integrated liner from a stretch material which is not a mesh material.

12. The pair of shorts with integrated liner of claim 8 further comprising a genital pouch for supporting a user's genitals.

13. The pair of shorts with integrated liner of claim 12 wherein the genital pouch comprises side panels that are formed in a mid-section of a front wall depending from the central portion of the partial waistband of the integrated liner.

14. A pair of shorts with an integrated liner comprising:

shorts constructed of a non-stretch material, the shorts having a non-stretchable waistband;

the integrated liner being constructed of a material, the integrated liner having a stretchable partial waistband and a fly area;

wherein the stretchable partial waistband of the integrated liner extends along a portion of a front of the integrated liner;

the stretchable partial waistband of the integrated liner being attached by clean finish stitching combined with a pinked seam finish to the non-stretchable waistband of the shorts at positions on the shorts that are approximately the same width as the fly area of the liner, wherein the stretchable partial waistband is dropped and curved in a downward, concave shape;

wherein a top portion of the integrated liner that is not the stretchable partial waistband is attached to a bottom of the non-stretchable waistband of the shorts; and further comprising a genital pouch configured to support a user's genitalia and phallus, wherein the genital pouch is on a front wall of the integrated liner, the pouch being formed from a pair of side panels being substantially parallel and laterally spaced apart.

15. The pair of shorts with integrated liner of claim 14 wherein the integrated liner is constructed from a stretch material which is not a mesh material.

16. The pair of shorts with integrated liner of claim 15 further comprising a mesh gusset.

17. The pair of shorts with integrated liner of claim 14 wherein a lower extremity of the pouch extends under and rearwardly of the front wall to form a perineum portion for covering rearwardly past a scrotum and to a perineum of the user.

18. The pair of shorts with integrated liner of claim 14 wherein the pouch has an inner lining that is smooth and seamless over a central penis-covering portion of the inner lining.

19. The shorts with integrated liner of claim 14 further comprising a fly formed as part of the short.

20. A pair of shorts for a user, the pair of shorts having an integral liner and comprising:

shorts constructed of a non-stretch material, the shorts having a non-stretchable waistband;

the integral liner constructed of a material, the integral liner having a stretchable partial waistband;

wherein the stretchable partial waistband of the integral liner extends along a portion of a front of the integral liner, wherein a central portion of the stretchable partial waistband is not attached to the waistband of the shorts, wherein lateral side portions of the stretchable partial waistband of the integral liner are attached by clean finish stitching combined with a pinked seam finish to the non-stretchable waistband of the shorts on either side of a fly area of the integral liner; wherein a remaining portion of the integral liner is attached to a bottom of the non-stretchable waistband of the shorts; and wherein the central portion of the stretchable partial waistband is dropped and curved in a downward, concave shape; and a genital pouch formed into the integral liner that is configured to support a user's genitals, wherein the genital pouch includes laterally spaced side panels formed in a mid-section of the front of the integral liner depending from the partial waistband of the liner to bisect the front of the integral liner, wherein a lower extremity of the genital pouch extends under and rearwardly of the front of the integral liner to form a perineum portion.

* * * * *